United States Patent [19]

Esquivel Yglesias

[11] 4,319,771

[45] Mar. 16, 1982

[54] PROGRAMMABLE AGENDA

[76] Inventor: Rafael Esquivel Yglesias, P.O. Box 3569, San Jose', Costa Rica

[21] Appl. No.: 150,617

[22] Filed: May 15, 1980

[51] Int. Cl.[3] ..... B42D 15/00; G09D 3/00

[52] U.S. Cl. ..... 283/2; 283/3; 40/119

[58] Field of Search ..... 40/119, 121; 283/2, 283/3, 4

[56] References Cited

U.S. PATENT DOCUMENTS

| | | | |
|---|---|---|---|
| 401,624 | 4/1889 | Balch | 40/119 X |
| 773,669 | 11/1904 | O'Shaughnessy | 283/2 |
| 1,415,883 | 5/1922 | Lewis | 283/2 |

*Primary Examiner*—Paul A. Bell
*Assistant Examiner*—John S. Brown
*Attorney, Agent, or Firm*—Spencer & Kaye

[57] ABSTRACT

A programmable agenda which is adapted by the user for use during any month of any year. The agenda comprises a series of sequentially numbered pages, each number corresponding to a date of the month. Each page is inscribed with a row of seven boxes, the boxes on all pages being in registration when the pages are aligned one on top of another. The boxes further define seven columns extending through the pages in a direction perpendicular to the planes of the aligned pages. Each box in a given row bears the name of a different day of the week and the boxes in each column bear the names of the days of the week in sequence. When the pages are aligned one on top of another, a single hole punched through the pages in the correct box will appear on each page in the box bearing the name of the day on which the date of the month inscribed on that page falls.

8 Claims, 8 Drawing Figures

PROGRAMMABLE AGENDA

BACKGROUND OF THE INVENTION

This invention relates to calendars, and in particular to pocket diary booklets for maintaining a monthly agenda.

Pocket-sized booklets, called "agendas" or "diaries", in which the pages correspond to days of the month are well known. In such agendas, each page is printed by the manufacturer with a day of the week and a date; for example, "Tuesday, Jan. 1, 1980." Space is left on the page so that the user can write in activities which are scheduled, and additional pages may be included for telephone numbers, notes, tax records and other information.

A problem inherent in agendas of this type is that the correspondence between a day of the week and a date, such as between Tuesday and January 1, is not the same in every year. Thus, while Jan. 1, 1980 fell on a Tuesday, Jan. 1, 1979 fell on a Monday and Jan. 1, 1981 will fall on a Thursday. January 1 will not fall on a Tuesday again until 1985.

Thus, if an excess of booklets for use during January of 1980 were printed, the surplus pages could not be used again for five years. In other cases, it may be as much as eleven years before surplus pages could be used again. After these intervals, the manufacturer may find that his stock has begun to deteriorate. Consequently, economics dictate that a manufacturer produce approximately the same number of booklets for each month that he can sell, which may require him to limit the number of booklets he manufactures to the number of orders he has received.

The manufacture of calendars presents similar problems. However, since calendars run from January to December, the manufacturer must supply a new set of pages only once a year. On the other hand, the user of a set of monthly agendas may wish to begin his set at any time during the year, so one user's annual set may run, for instance, from June to May. Thus, not only must the manufacturer take orders for the agendas, he must take them every month, and predicate production on the monthly orders. This makes long-term production planning difficult, and can result in delayed deliveries, reduced efficiency and increased costs.

Since the manufacturer must wait for orders to be received, each order is virtually "custom made." This limits marketing of the agendas to catalog sales, mail orders through magazines and the like. Due to the limited life of the agendas, they are generally not sold in retail outlets.

Further, a user who loses an agenda for a particular month must attempt to obtain a replacement directly from the manufacturer. This can be time consuming, even if the manufacturer has extra copies on hand and is willing to provide individual copies.

There exists, therefore, a need for a standardized agenda which can be mass produced, and will indicate for the user the date of the month and the corresponding day of the week.

SUMMARY OF THE INVENTION

It is an object of the present invention to provide a programmable agenda which is usable during any month of any year.

It is another object of the present invention to provide an agenda which may be programmed by the user to indicate the day of the week which corresponds to the date printed on each page of the agenda.

To achieve these objects, the present invention provides a programmable agenda comprising a series of pages which are sequentially numbered, the number on each page corresponding to a date in a month. A row of seven boxes is inscribed on each page, the boxes on all pages being in registration when the pages are aligned one on top of another. The boxes further define seven columns extending through the pages in a direction perpendicular to the planes of the aligned pages. Each box in a given row bears the name of a different day of the week, and the boxes in each column bear the names of the days of the week in sequence.

As a consequence of this arrangement, a hole made in a box which bears the name of a day of the week on a page of the agenda bearing a date which falls on that day, and which hole extends through all the boxes in the column, will be located on each page in a box bearing the name of the day on which the date inscribed on that page falls.

It is understood that a row of boxes as described above will generally be in a straight line, but may assume other configurations within the scope of the invention.

The programmable agenda described above may be used during any month of any year. Two steps are required to prepare the agenda for use:

(1) The user indicates on the cover of the agenda the month and year which it represents.

(2) The user aligns the pages and punches a hole through the aligned pages. The hole is made in a box in which is printed the day of the week which corresponds to the first day of the month.

As the user opens the pages in booklet form, he will find that a hole will appear on each page in a box in which is printed the day of the week which corresponds to the date of the month inscribed on that page.

When the agenda described takes the form of a pocket diary booklet, it will include a front and a rear cover, and the pages will be bound within the cover. A calendar for the month and year for which the agenda is to be used is also preferably affixed to the front cover.

The invention is also applicable to other types of agendas in which there is page-day correspondence, such as desk calendars.

The row of seven boxes can be inscribed on each page, on both faces, or only one face of each page.

It is to be understood that both the foregoing general description and the following detailed description are exemplary, but are not restrictive of the invention.

DESCRIPTION OF THE PREFERRED EMBODIMENTS

Figure 1:
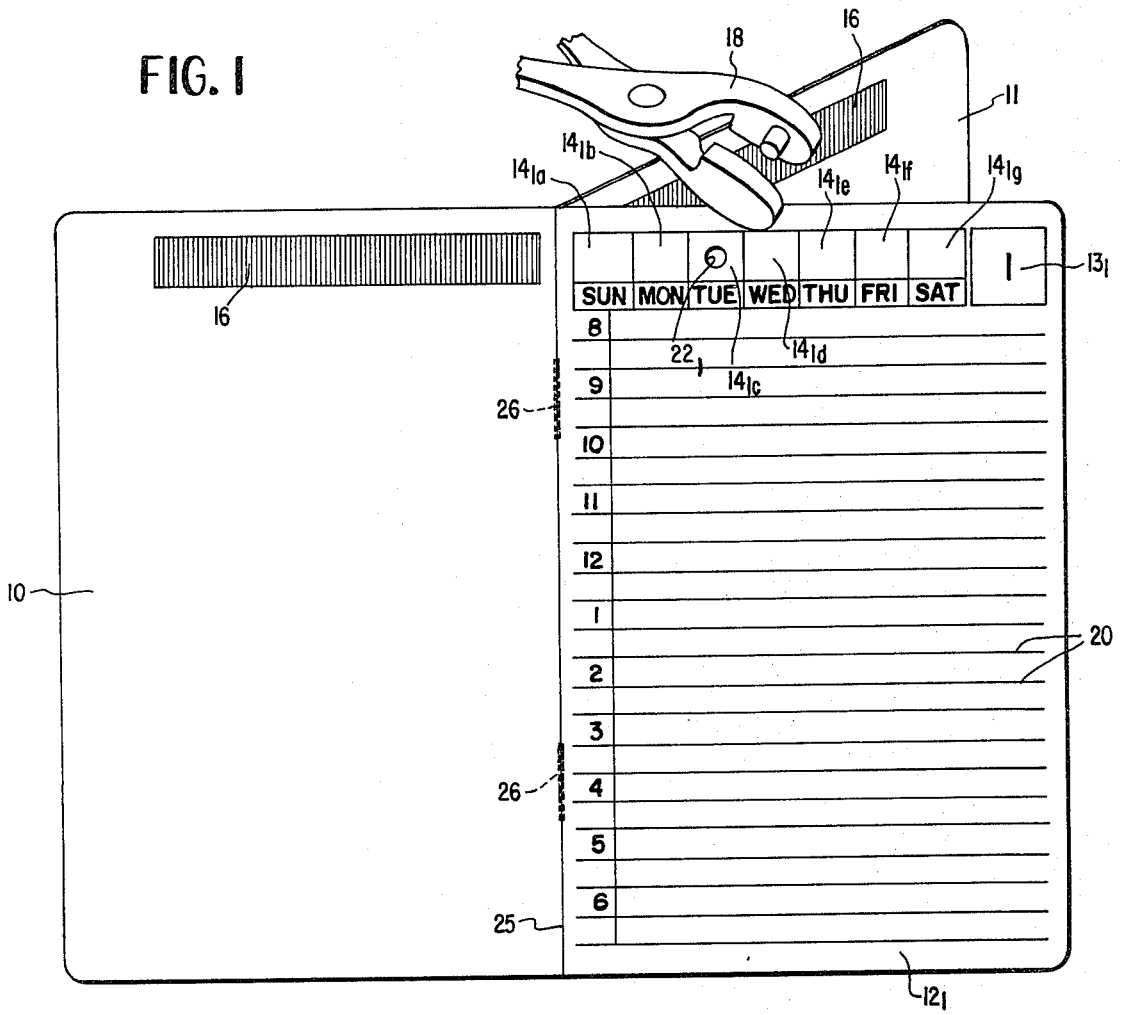
FIG. 1 shows the covers and first page of the agenda in booklet form, together with a tool for punching holes in selected boxes.

Referring to FIG. 1, there is shown an agenda which has been adapted for use during January 1980 having a front cover 10, rear cover 11 and first page $\mathbf{12}_1$. A box $\mathbf{13}_1$, provided in the upper righthand corner of page $\mathbf{12}_1$, has a "1" inscribed therein to signify that this page is to be used on the first day of the month. A row of boxes $14_{1a}$ through $14_{1g}$ is inscribed on page $12_1$, the boxes being labelled from left to right "SUN, MON, TUE, WED, THU, FRI, SAT." Lines 20 are provided on the page to permit the user to schedule appointments or write in other information.

With all agenda pages aligned one on top of another, punch 18 is used to place a hole $22_1$ in box $14_{1c}$ labelled "TUE" since the date to which this page corresponds, Jan. 1, 1980, falls on a Tuesday. A marker 16 of a color contrasting with that of the pages is provided on the inside front and rear covers so that the boxes in which the holes have been punched can be easily seen.

Figure 2:
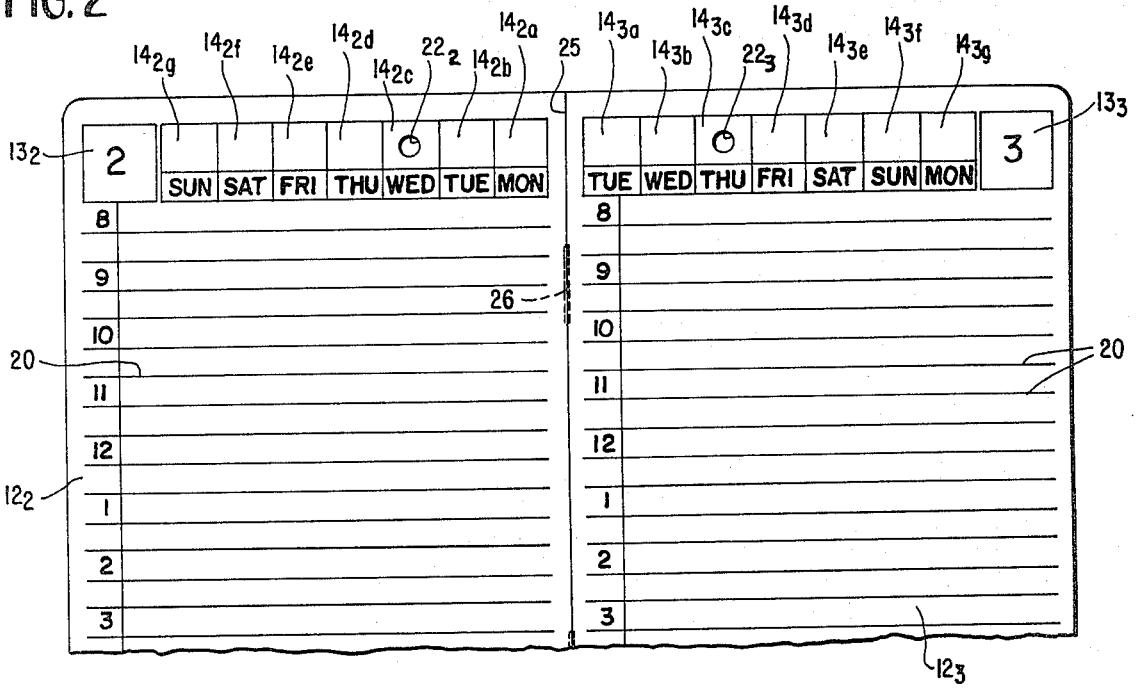
FIG. 2 shows the agenda opened to particular pages.
Figure 3A:
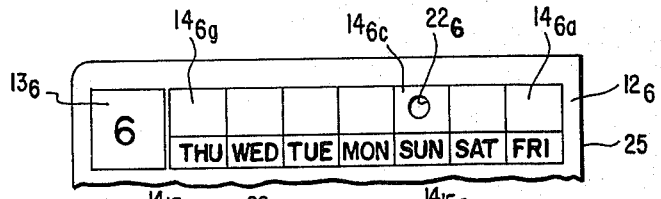
FIGS. 3*a*–3*e* show the boxes inscribed on five pages of the agenda.
Figure 3B:
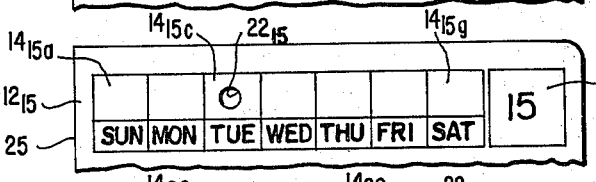
Figure 3C:
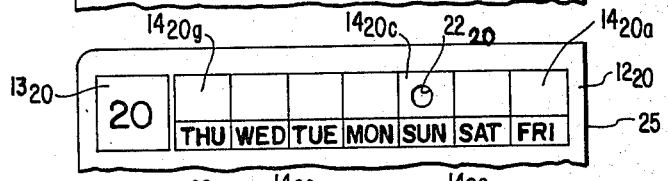
Figure 3D:
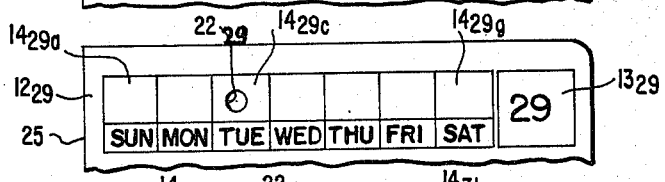
Figure 3E:
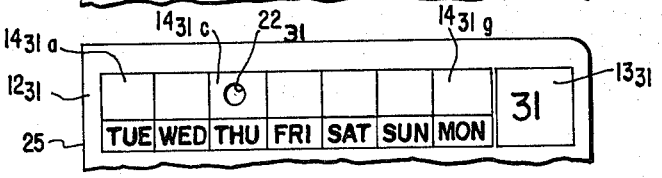

FIG. 2 shows the agenda opened to expose the next two pages, $12_2$ and $12_3$. Page $12_2$ has a box $13_2$ inscribed in its upper left-hand corner with a "2" therein to signify that the page is to be used on the second day of the month; likewise, page $12_3$ has a "3" inscribed in a box $13_3$ located at its upper right-hand corner. Page $12_2$ has a row of boxes $14_{2a}$ through $14_{2g}$, the row starting with box $14_{2a}$ being closest to the binding 25 of the agenda. Page $12_3$ has a row of boxes $14_{3a}$ through $14_{3g}$, the row also starting with the box closest to binding 25.

When an agenda is closed and the pages are aligned one on top of another, boxes $14_{1a}$, $14_{2a}$, $14_{3a}$ . . . $14_{31a}$ are in registration, as are boxes $14_{1b}$, $14_{2b}$, $14_{3b}$ . . . $14_{31b}$, and $14_{1c}$, $14_{2c}$, $14_{3c}$ . . . $14_{31c}$. Seven columns of boxes $14_a$, $14_b$, $14_c$, $14_d$, $14_e$, $14_f$ and $14_g$ are thus formed, each column extending through the booklet perpendicular to the planes of the closed pages. That is, column $14_a$ comprises boxes $14_{1a}$, $14_{2a}$, $14_{3a}$ . . . $14_{31a}$; column $14_b$ has boxes $14_{1b}$, $14_{2b}$, $14_{3b}$ . . . $14_{31b}$; column $14_c$ has boxes $14_{1c}$, $14_{2c}$, $14_{3c}$ . . . $14_{31c}$; column $14_d$ has boxes $14_{1d}$, $14_{2d}$, $14_{3d}$ . . . $14_{31d}$; column $14_e$ has boxes $14_{1e}$, $14_{2e}$, $14_{3e}$ . . . $14_{31e}$; column $14_f$ has boxes $14_{1f}$, $14_{2f}$, $14_{3f}$ . . . $14_{31f}$; and column $14_g$ has boxes $14_{1g}$, $14_{2g}$, $14_{3g}$ . . . $14_{31g}$.

The boxes in each column are labelled with the days of the week in sequence. Thus, box $14_{1a}$ is labelled "SUN", box $14_{2a}$ is labelled "MON", box $14_{3a}$ is labelled "TUE", and so on to box $14_{31a}$ which is labelled "TUE."

The boxes in column $14_c$ are similarly labelled in sequence, with box $14_{1c}$ being designated "TUE", box $14_{2c}$ "WED" and box $14_{3c}$ "THU." In an agenda to be used during January 1980, a set of holes $22_1$ through $22_{31}$ appears in corresponding boxes $14_{1c}$ through $14_{31c}$ on pages $12_1$ to $12_{31}$ since the hole is placed through box $14_{1c}$ with all pages in registration.

FIGS. 3a–3e show the tops of pages $12_6$, $12_{15}$, $12_{20}$, $12_{29}$ and $12_{31}$ of the agenda. Boxes $13_6$, $13_{15}$, $13_{20}$, $13_{29}$ and $13_{31}$ are provided on corresponding pages having the date inscribed therein. A row of boxes $14_a$ through $14_g$ is also provided on each page, each row starting with the box closest to the binding. On each page, hole 22 appears in the box in column $14_c$, which in every case is inscribed with the name of the day on which the date corresponding to the page falls during January 1980.

During other months the hole might be placed in another box on the first page, and hence, in another column of boxes. However, because the boxes in the column are in sequence, the hole will then appear on every page in the box labelled with the day on which the date falls.

Figure 4:
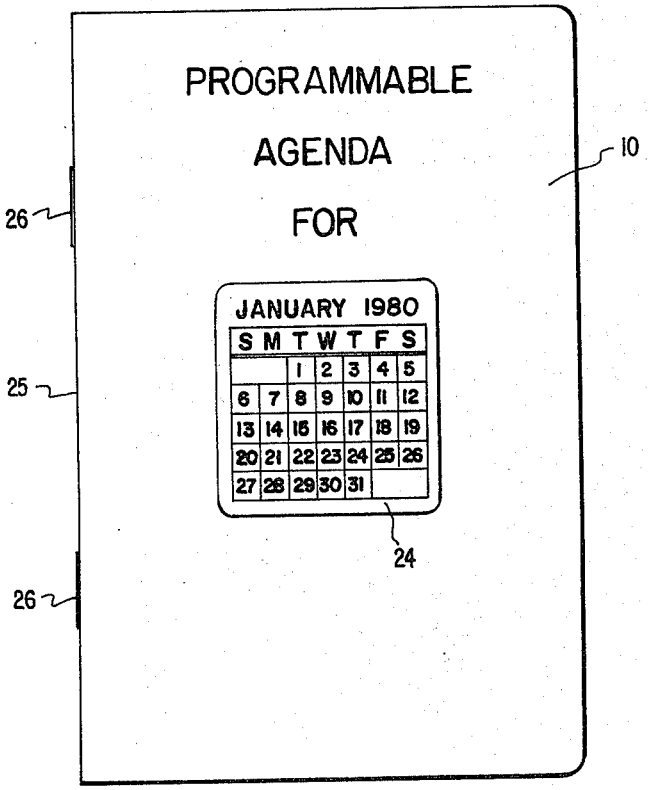
FIG. 4 shows the front cover of the agenda.

FIG. 4 shows the front of the front cover 10 of the monthly agenda. A calendar label 24 or any other type of identification is placed on the cover by the user to indicate the month and year during which the agenda is being used. The pages are held together by staples 26, or any other type of suitable binding.

Thus, the user must perform only two steps to program the agenda or diary for any particular month. He first applies an identification to the cover which indicates the month and year during which the agenda is to be used. He then punches a hole in the box on the first page in which appears the day name on which the first day of the month falls. The hole is punched with the pages aligned so that the hole passes through all the pages. By punching a hole in the correct box on the initial page, or any other page, the user will find that the hole will appear in the correct box on all pages punched.

Many additions to and variations in the basic agenda format are contemplated. Thus, instructions for use or other information may be printed on the inside front cover, inside back cover, any other page, or not printed at all. The first page need not be printed in the regular agenda format shown in the foregoing but may contain a row of boxes and a direction to punch a hole in the box in which appears the day of the first of the month. The page for the first day of the month, with appointment times, would then appear at any selected subsequent point in the agenda. Pages may be included at any point in the agenda for notes, telephone numbers, and other information as long as the days of the week are printed in the boxes in the columns in sequence. The rows of boxes may also appear on the page opposite the date, if desired. Furthermore, the rows of boxes can be inscribed vertically or following any other pattern on the pages rather than horizontally.

The individual components of the pocket agenda shown, the monthly booklets, month/year labels, a pocket cover if desired, and other accessories commonly included with such booklets may be purchased as a package, or separately, unit by unit. Because the booklets are, with the exception of the labels, identical, they may be manufactured in considerable quantities, and furnished to retail outlets in bulk without concern about expiration of the merchandise. The only items in the system which vary are the month/year labels, but these are sufficiently inexpensive that they can also be printed in bulk. Additionally, it is possible to do away with the need for labels by simply writing the month and year on the cover of each agenda prior to use.

The hole may be made by any standard hole punch commonly available in homes and offices.

It will be understood that the above description of the present invention is susceptible to various modifications, changes and adaptations, and the same are intended to be comprehended within the meaning and range of equivalents of the appended claims.

What is claimed is:

1. A programmable agenda comprising a series of sequentially numbered pages capable of being aligned one on top of another, each number corresponding to a date in a month, each page having inscribed thereon a row of seven boxes, the boxes on all pages being in registration when the pages are aligned one on top of another, said boxes further defining seven columns extending in a direction perpendicular to the plane of each page when the pages are aligned one on top of another, each box in a given row bearing the name of a different day of the week, and the boxes in each column bearing the names of the days of the week in sequence.

2. A programmable agenda according to claim 1, which is in the form of an agenda additionally comprising a front cover, a rear cover, and means for binding said pages to said covers.

3. A programmable agenda according to claim 2, wherein said binding means comprises at least one staple.

4. A programmable agenda according to claim 2, additionally comprising identification on said front cover for indicating the month and year during which the agenda is to be used.

5. A programmable agenda according to claim 4, wherein said identification means is a calendar label having an adhesive backing.

6. A programmable agenda according to claim 2, wherein a marker which is different in color from that of the pages is provided on an inside cover, said marker being aligned with said row of boxes.

7. A programmable agenda according to claim 2, additionally comprising a label with adhesive backing attached to said front cover as means for indicating the month and year of use of said agenda, wherein a marker having a color different from that of the pages is provided on the inside front and inside rear covers, which marker is aligned with said row of boxes.

8. A programmable agenda according to claim 1 or 7, wherein said row of boxes comprises a block inscribed substantially parallel to the top edge of the page on which it appears, which block is divided into seven boxes each of which boxes has inscribed therein a different day of the week, wherein in the sequence which corresponds to the first day of the month, the first box represents the first day of the week, the seventh box represents the seventh day of the week, the intervening days being inscribed therebetween in sequence.

* * * * *